United States Patent [19]

Hasbrouck

[11] 4,448,003

[45] May 15, 1984

[54] TUBE CONNECTIONS

[75] Inventor: Gene B. Hasbrouck, Corry, Pa.

[73] Assignee: Hon Industries, Inc., Muscatine, Iowa

[21] Appl. No.: 331,649

[22] Filed: Dec. 17, 1981

[51] Int. Cl.[3] ..... E04B 2/74

[52] U.S. Cl. ..... 52/239; 160/351; 403/362

[58] Field of Search ..... 52/239,281, 285, 584; 403/171, 172, 176,362, 372; 160/135, 351

[56] References Cited

U.S. PATENT DOCUMENTS

| | | | |
|---|---|---|---|
| 852,710 | 5/1907 | Fletcher . | |
| 1,788,096 | 1/1931 | Friedemann . | |
| 3,213,580 | 10/1965 | Mark | 52/239 |
| 3,545,625 | 12/1970 | MacMillan | 403/171 |
| 3,606,408 | 9/1971 | Wagner . | |
| 3,854,831 | 12/1974 | Gutner | 403/176 |
| 3,858,989 | 9/1973 | Field | 403/171 |
| 3,974,610 | 8/1976 | Logie | 52/584 |
| 4,090,798 | 5/1978 | Bonton | 403/171 |
| 4,250,676 | 2/1981 | Presby | 52/239 |

*Primary Examiner*—Peter M. Caun

*Attorney, Agent, or Firm*—Neuman, Williams, Anderson & Olson

[57] ABSTRACT

A tube connector assembly is disclosed which comprises a post and flexible reed-like elements secured to the sides of the post. The reeds are selectively and adjustably spaced laterally from the post, as by set screws, to vary the effective diameter of the connector unit. Thereby the connector is adjusted to effect a telescopic slidable force fit in a tube or tubes for adjustable attachment of supports to portable partition panels, attachment of extension tubes, splicing panels together, and the like.

32 Claims, 8 Drawing Figures

FIG. 1
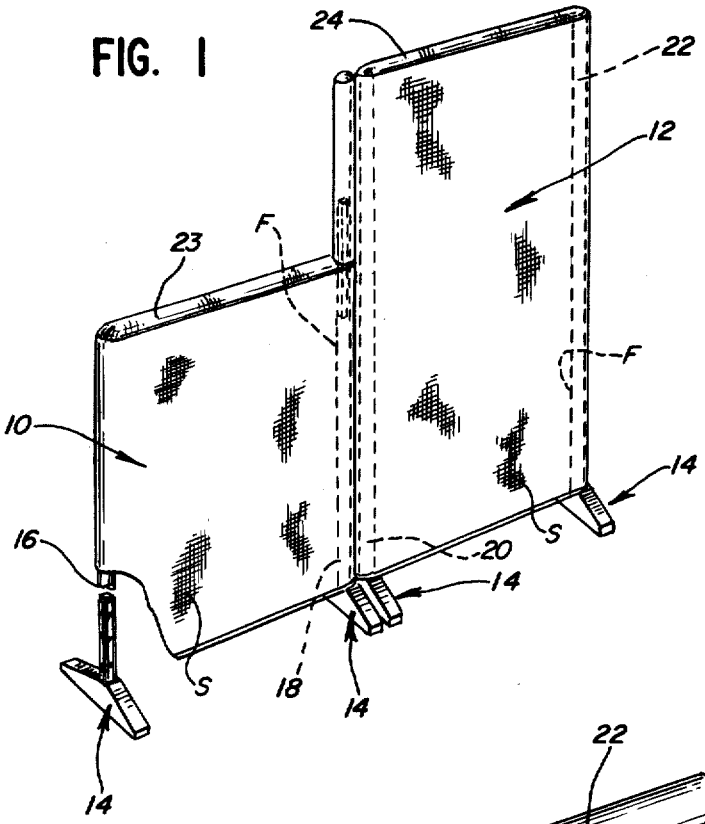
FIG. 2
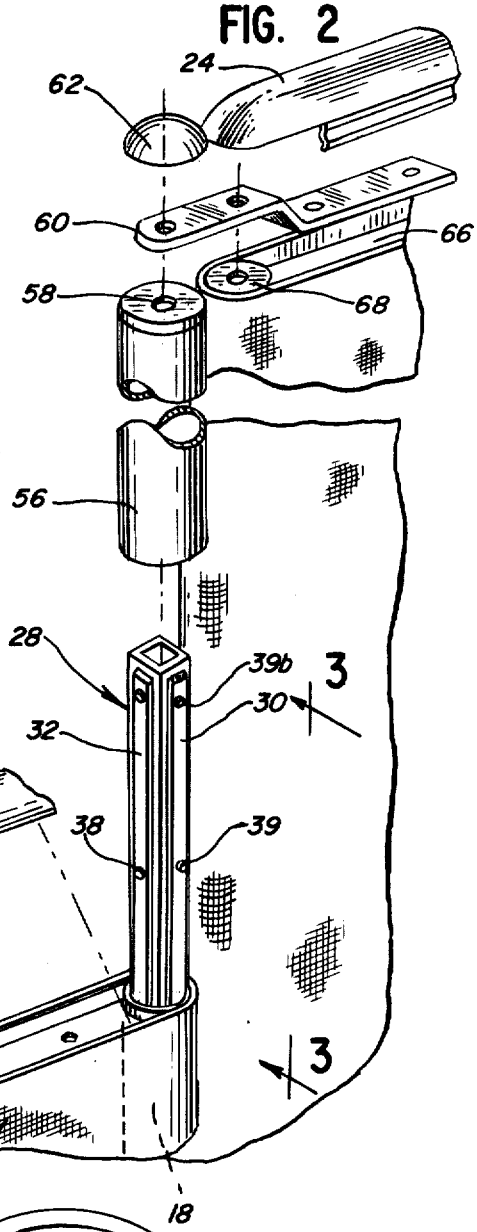
FIG. 3
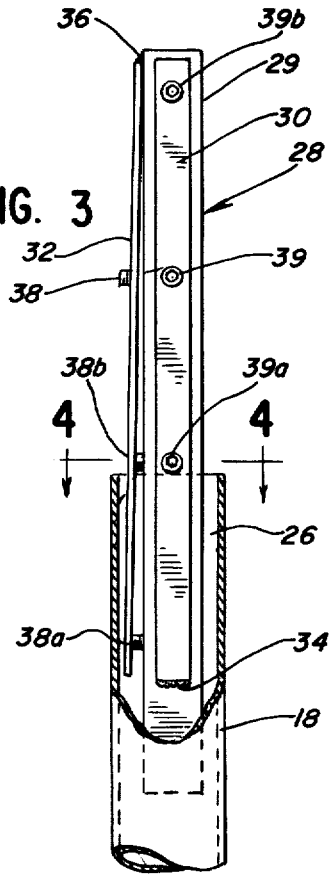
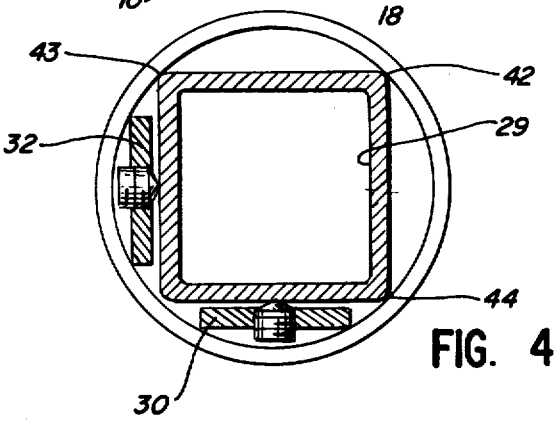
FIG. 4

TUBE CONNECTIONS

BACKGROUND OF THE INVENTION

This invention relates to an improved tube connector and the method of forming a tube connector assembly therewith. More particularly, it relates to an adjustable tube connector for insertion into a sleeve portion at the open end of a tube, or, if two tubes are to be connected, into the sleeves formed by adjacent or proximate open ends of the pair of tubes. Such constructions are useful with light weight, movable, prefabricated partition panels in so-called office landscape systems. In the present invention, the connector includes a post which is provided with a reed or a pair of reeds, each fastened at one end to the post, so that most of the length of each reed is adjustable laterally of the post to afford a range of fixed, effective diameters for the connector. The connector's diameter may thus be enlarged in order to afford a plurality of longitudinal lines or areas of engagement with the inside surfaces of the sleeve portions at the ends of the tubes. Because each connector engages its respective sleeve portion so firmly the opposed ends of the tubes may be disposed a substantial, fixed distance apart, if desired, as well as abutting one another. In another application, a single connector may be utilized between a floor stand and an upright tube to hold the tube in a fixed, vertical position. The illustrated panel system is included in the "2000" panel system presently being marketed commercially by Corry Jamestown Corporation of Corry, Pa., which is a division of HON INDUSTRIES, Inc., of Muscatine, Iowa.

Presently, a variety of methods and structures for joining the ends of tubular members exists. These constructions include telescopically fitting portions at the ends of tubular members, a splicer block inserted into two adjacent tube ends, straps fastened to both tube ends, a hinged pair of flanges fastened into the walls of each tube end, and an extension on one tube end wedged against the inside of another tube by a set screw lodged in one of the tube walls. Each of these constructions includes its own unique aspects, but each one also entails a number of drawbacks. One manifest problem is the requirement of penetrating a wall of the tubular member with a screw or similar device, thus creating an unsightly or obvious joint. Another problem is the need for access which an assembler must have to the adjustment or movable elements in the tube joint through the wall of the outer tubular member. These and other disadvantages are overcome by the present invention.

OBJECTS OF THE INVENTION

It is an object of this invention to provide a tube connector having an adjustable effective diameter for frictional engagement on the tube walls inside the end of a tube.

It is a further object of this invention to provide an improved tube connector which affords selective longitudinal positioning of the joined members, such as for height adjustment support of partition panels.

It is a further object of this invention to provide an improved tube connector system for engaging the inside of the end portion of a tube while maintaining the walls of the tube intact.

It is still a further object of this invention to provide an improved system for joining a pair of tubes which incorporates a splice fitting inserted into the ends of the tubes. The fitting has an adjustable effective diameter frictionally and securely disposed upon the inside walls at the joined ends of the tubes when the diameters inside the tubes are of different proportions.

These and yet additional objects and features of the invention will become apparent from the following detailed discussion of exemplary embodiments, and from the attached drawings and appended claims.

SUMMARY OF THE INVENTION

In a preferred form of this invention, an improved tube connection is achieved at the open end of a tube by utilizing a connector which comprises a post element having a portion telescopically nestable within the sleeve portion at the open end of the tube and gripping means disposed upon the post element, on the portion of the post element within the sleeve. Means also are provided for adjustably spacing portions of the gripping means away from the post element and for forcing the edges of the gripping means and the post element against the inside surfaces of the sleeve.

BRIEF DESCRIPTION OF THE DRAWINGS

For a more complete understanding of this invention, reference should be made to the accompanying drawings in which:

FIG. 1 is a perspective view of a pair of wall panels of different heights standing side by side and employing teachings of this invention both in connecting the upper and lower ends of a pair of tubes of the panels and also in connecting the bottom ends of the panel tubes to floor stands which support the assembly;

FIG. 2 is an enlarged perspective view, partially broken away and partially exploded, of a portion of the panel assembly shown in FIG. 1;

FIG. 3 is an enlarged side view, partially broken away, of the lower tube and the tube connector in the abutting pair of tubes shown in the construction in FIG. 2, taken in the direction of the arrows 3—3 in FIG. 2 during a step of assembly just prior to the positions shown in FIG. 2;

FIG. 4 is a sectional view of the tube and tube connector shown in FIG. 3 taken along the line 4—4 in FIG. 3;

Figure 6:
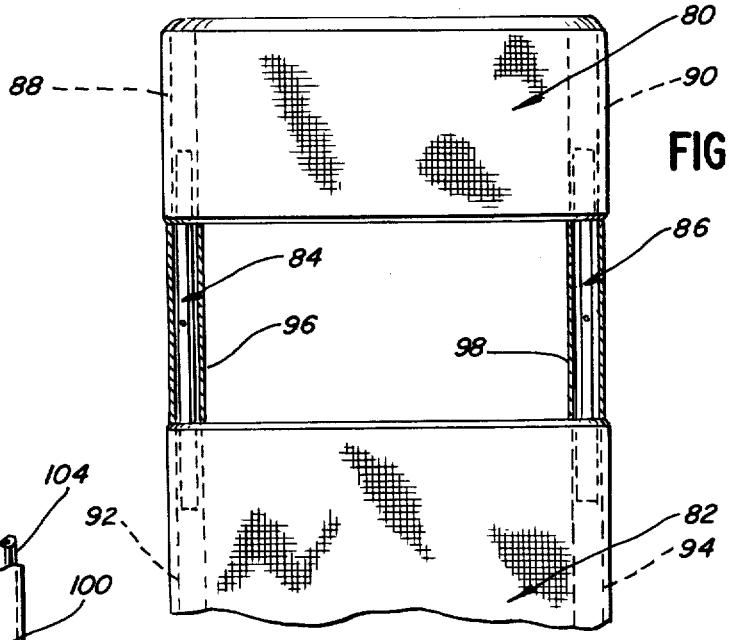
FIG. 6 is a view illustrating a use of a modified form of the tube connector shown in FIG. 3 to connect the ends of tubes in a wall panel assembly wherein the upper panel is spaced apart from the lower panel to create a pass-through opening.

It should be understood that the drawings are not necessarily to scale and that the embodiments somtimes are illustrated in part by phantom lines and fragmentary views. In certain instances, details of the actual structure which are not necessary for the understanding of the present invention may have been omitted. It also should be understood, of course, that the invention is not necessarily limited to the particular embodiments illustrated herein.

DETAILED DESCRIPTION OF THE PREFERRED EMBODIMENT

In the arrangement of wall panels shown in FIG. 1, a pair of panels consisting of a low panel 10 and a high panel 12 are mounted on foot anchors 14 and placed edge to edge. The inner skeleton of each panel is an open frame F which includes a vertical hollow round post tube at each side and appropriate rigid transverse members extending between and secured to the side tubular posts, e.g., transverse channel members such as the strut 46 (FIG. 2). Appropriate core materials such as of glass fiber, are included for sound attenuation purposes. The frame F is normally covered by a fabric sheath S.

As shown in FIG. 1, the low panel 10 includes a tube 16 at the left and a tube 18 at the right. The high panel includes a tube 20 at the left and a tube 22 at the right. The top edges of the panels, and normally the top ends of the tubes, are covered with top caps such as 23 and 24, as will be more fully described below. All of the tubular members, as 18 (FIGS. 2 and 3), include an open ended or sleeve portion 26 (FIG. 3) into which a tube connector such as 28 can be nested.

Figure 4A:
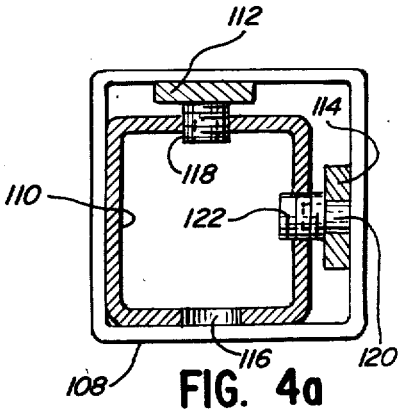
FIG. 4*a* is a sectional view of a modified form of tube and tube connector at the same point of cross-section as the sectional view shown in FIG. 4.

The tube connector 28 includes a central post member 29 to which, on adjacent sides, reeds 30 and 32 are affixed by means such as welds 34 and 36 (see FIG. 3). The welds are located only at one end of each reed, but are opposite each other so that weld 34 is adjacent one end of the post member while weld 36 is located adjacent the other end of the post member. Reed 32 may be flexed from the weld 36 and away from the post member 29, so that a substantial portion of the length of the reed may be spaced away from the body of the post member. Reed 30 may be similarly flexed away from the post member. Such spacing increases the effective diameter of the entire connector made up of the post member and the reeds, and such effective diameter is adjustable due to the disposition of a number of set screws 38 and 39 along the lengths of the reeds. The set screws extend through the reeds in threaded mountings and abut the post 29 so that they may be advanced or withdrawn and thus vary and control the distance at which all points along the length of each reed are extended and held away from the post member. These spacing distances of each reed from the post may vary from one set screw to another, as desired or found necessary. It has been found that disposing the set screws in threaded mountings in the reeds, as shown, creates a highly effective means of engagement. However, the location of the mountings and screws may also be modified so that the threaded mountings are disposed in the post member and the set screws abut the inner surfaces of the reeds. Access to set screws so mounted in the post 29, for adjusting those screws, may be gained through apertures in the reeds or through the opposite side of the post members as shown in FIG. 4*a* and described hereinafter. Other similar alternatives are readily available to achieve a set screw or other threaded element control for adjustably spacing the reeds away from the post member.

Referring particularly to FIG. 4, the corners 42, 43, and 44 of the post member contact the inside walls of the sleeve portion 26 of tube 18 at points or edges spaced apart from the wall contacts made by the edges of reeds 30 and 32, thereby securely fastening the tubular member and the post member to each other in a frictional engagement along most of the length of the edges of the reeds and the corners of the post member. When both reeds are in their flexed positions, as shown in FIG. 4, all three corners of the post member contact the inside walls of the sleeve portion, because the sleeve portion may be slightly distorted due to the pressure exerted by the set screws between the reeds and the post member. Moreover, the plurality of set screws positioned along the lengths of each reed are capable of adjustment so that the reeds may be securely held against the inside walls of the sleeve throughout most of the length of each reed, thus accommodating small variances in the diameter of the sleeve portion of the tube. While a pair of adjacent reeds are shown in the assembly illustrated, it will be immediately apparent that only one reed may be necessary to increase the effective diameter of a post member sufficiently to make a satisfactory frictional contact.

The illustrated form of the post member 29 is rectangular. However, a post member with a round or elliptical cross section may be used, although the number of rather sharp lines of contact on the inside of the sleeve wall would be reduced. Clearance for the set screws would be achieved in such an arrangement by modifying the reeds to include concave cross sections, for example.

To assemble a tube connector and tube in the manner contemplated by this invention, and with particular reference to FIGS. 3 and 4 in the accompanying drawings, the post member 29 with its associated reeds 30 and 32 is first pushed into the sleeve portion 26 of the tube 18 down to and just short of the first set screw 38*a* which is closest to weld 34. There, set screw 38*a* is still accessible above the end of sleeve portion 26. The screw 38*a* is adjusted by turning it to contact the body of the post member 29 and then is further rotated to move reed 32 outwardly, flexing reed 32 until the reed is snugly disposed against the inner wall of the sleeve portion 26. At this point, the post member fitting should be snug in the sleeve and should not have any free play, but the reed 32 should not be forced by further rotation of the set screw 38*a*, thus permitting the tube connector 28 to slide smoothly with a force fit inside the sleeve portion 26. Next, the tube connector 28 is pushed further into the sleeve portion 26 until the next set screw 38*b* in reed 32 is disposed immediately above the edge of the sleeve portion 26. Such movement also brings the first set screw 39*a* in reed 30, which screw is immediately adjacent set screw 38*b*, to a point just above the edge of the sleeve portion 26. Both set screws 38*b* and 39*a* are then rotated to adjust the respective reed portions so that that section of the connector 28 fits tightly in the sleeve portion 26. At this point, the tube connector 28 should be movable into the sleeve portion 26 only by tapping it firmly with a hammer. Finally, the tube connector is driven further, as by using a hammer, into the sleeve portion so that set screws 38*b* and 39*a* are disposed about an inch inside the sleeve portion 26. The connector will then be disposed inside the sleeve as shown in cross section in FIG. 4.

The tube connector 28, when assembled in the tube 18 in the manner just described, is shown in FIG. 2, the tube connector extending for a portion of its length above the end of tube 18. FIG. 2 also illustrates a portion of the internal frame of the low panel 10. A channel-shaped strut 46 has its side flanges 48 welded (weld not shown) to the outer surface of tubes 16 and 18, with the open channel forming the upper edge of the low panel 10 and extending between tubes 16 and 18. The top edge of the panel 10 is decoratively finished by insertion of the top cap 23 into the recessed portion of strut 46 by means of clips 54 or other similar means.

In order to decoratively cover the exposed end of the connector 28 and to provide a means for joining the panel 10 to the high panel 12, tube 56, covered with a fabric to match the fabric covering panels 10 and 12, is arranged to be fastened on to the connector 28 in a manner similar to that described above in inserting the connector 28 into the sleeve portion 26 of tube 18. The fabric covered tube 56, in other words, is first placed over the exposed end of tube connector 28 to the point where the uppermost set screw **39*b* is just accessible, this set screw is rotated to bring the reed 30 and post 29 into firm slidable contact with the inside surface of the fabric covered tube 56, the tube 56 is pushed further onto the connector to the next set of set screws 38 and 39, and the latter are then tightened to bring the reeds and the corners of the post member 29 into firm frictional contact with the inside of the fabric covered tube 56. Finally the fabric covered tube 56 is driven completely onto the tube connector so that the lower end of tube 56 abuts the upper end of tube 18**.

When the fabric covered tube 56 is completely assembled onto the tube connector 28 in the manner just described, the upper end is at the level of the upper end of tube 20. Thus, the low panel 10 may be joined to the high panel 12 at those adjacent coplanar ends in the usual manner of joining two adjacent panels of equal height. A plug 58 is disposed in the upper end of the fabric covered tube 56, and a strap 60, together with a finish cap 62, are attached to the plug 58 by any suitable means. The upper edge of the high panel 12 is provided with means such as strut 66 and plug 68 for similar engagement with the strap 60. Top cap 24, in a manner similar to that described above with respect to top cap 22, may be snapped onto the upper edge of panel 12 to complete the decorative portion of the finished upper edge of panel 12.

It will be noted that in each assembly just described, and in those which follow, the set screws are accessible at the times when it is necessary to adjust them, and there is no need for providing a means of access to them by breaching the walls of any of the tubular members.

Figure 5:
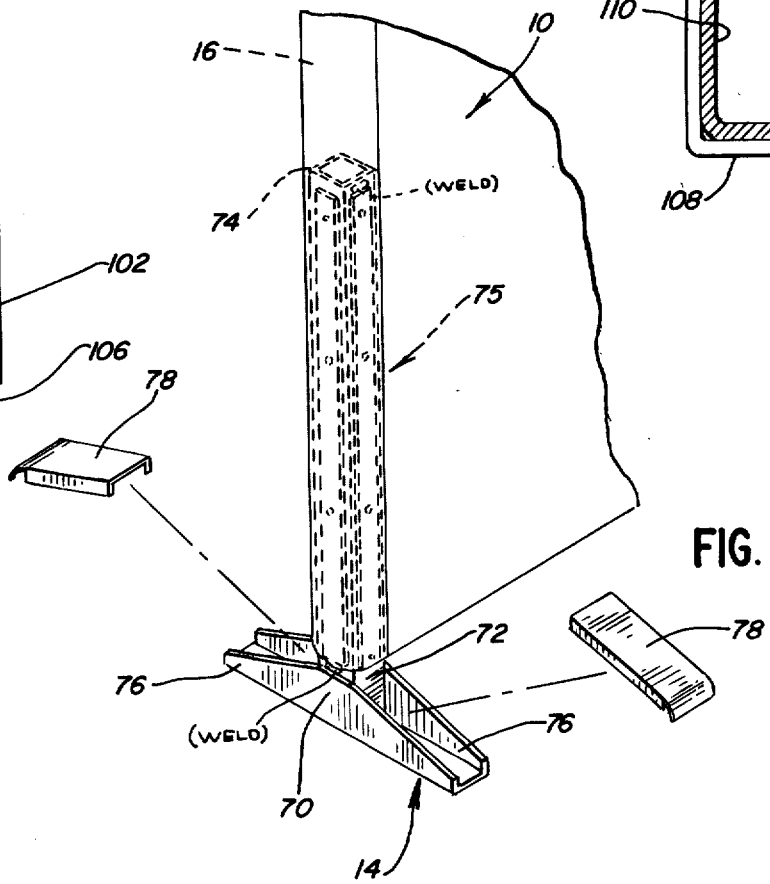
FIG. 5 is an enlarged view of another portion of one of the wall panels shown in FIG. 1 illustrating a use of a modified form of the tube connector shown in FIG. 3 to connect a tube in one of the wall panels to a floor stand.

The tube connector described above can be used in a variety of environments and modifications. One such modification is an attachment to foot 14 at the base of a wall panel as shown in FIGS. 1 and 5. The foot 14 includes a socket portion 70, into which the lower end 72 of a post member 74 of a tube connector 75 or 28 can be inserted and fixed, as by welding. Leg portions 76 of the foot 14 extend outwardly from the socket portion to provide a stable base on which to support the panel 10 in an upright position. Cover caps 78 are disposed over the leg portions 76 to provide decorative and protective closures for the upper faces of the of the leg portions. In this modification, the tube 16 is telescoped over the entire upper end of a tube connector extending upwardly from the socket portion 70. The set screws in the tube connector are progressively tightened during assembly, in the manner described above. The lower set screws of the connector 75 are adjusted as necessary to control and limit the insertion of the connector 75 into the tube 16. In this manner the height adjustment of each foot support 14 effectively is adjusted. By way of example, this adjustment permits leveling of a panel or a series of panels which are supported on an uneven floor.

In another modification (see FIG. 6), an open pass-through is created between short upper and lower panels 80 and 82 which are constructed of frames covered with fabric in the same manner as panels 10 and 12. In this application, a pair of tube connectors 84 and 86 are utilized. Most, but not all, of the set screws in the reeds are covered by the tubes 88, 90, 92, and 94 inside the panels 80 and 82. The portions of the connectors 84 and 86 between the panels 80 and 82 are covered by intermediate fabric covered spacer tubes or sleeves 96 and 98. Secure frictional engagement of the connectors upon the inside walls of the ends of the tubes 88, 90, 92 and 94 is still provided.

In still another modification (see FIG. 7), a pair of end-to-end abutting wall panels 100 and 102, constructed as described above, include tubes such as 104 and 106 in their aligned vertical edges. Each such pair of tubes is joined by a tube connector, like the tube connectors 84 and 86 in FIG. 6. The manner of constructing this modification is the same as described above with respect to the pass-through assembly shown in FIG. 6, except that the upper and lower panels are not spaced apart but instead are pushed together until their bottom and top edges, respectively, are abutted to each other.

The principles of the present invention may be applied in various modified forms of tube connectors and tubes. For example, as shown in FIG. **4*a*, a square tube 108 is assembled with a square post member 110. Alternative means for forcing the reeds 112 and 114 against the inside walls of the tube 108 are shown. With respect to reed 112, an aperture 116 is formed in one side of the post member 110, and a screw element 118 is mounted in the opposite wall of the post. When element 118 is rotated, as by inserting a screwdriver or other appropriate socket-engaging tool through aperture 116, the element 118 contacts the reed 112 and forces the reed outward to engage the adjacent wall of tube 108. With respect to reed 114, an aperture 120 is formed in the reed, giving access to screw element 122 mounted in a wall of the post member 110. As illustrated, the screw element 122 is of larger diameter than the aperture 120. When element 122 is rotated, as by inserting a screwdriver or other socket-engaging tool through aperture 120, the element 122 is brought into contact with the reed 114 and forces the reed 114 against the adjacent wall of tube 108**. In both alternatives, shown here in the same post member for illustrative purposes only, the post member and reed are pressed outwardly to engage against the inside walls of the tube in a tight, frictional engagement which holds the connector and the tube securely together. Other adjustment means may also be utilized for forcing or wedging the reeds or similar gripping members away from the post member, and the post member and reeds against the inside walls of a tube, in accordance with the principles illustrated and described. Each gripping member could be formed of multiple sections, but a single long reed is preferred.

Figure 7:
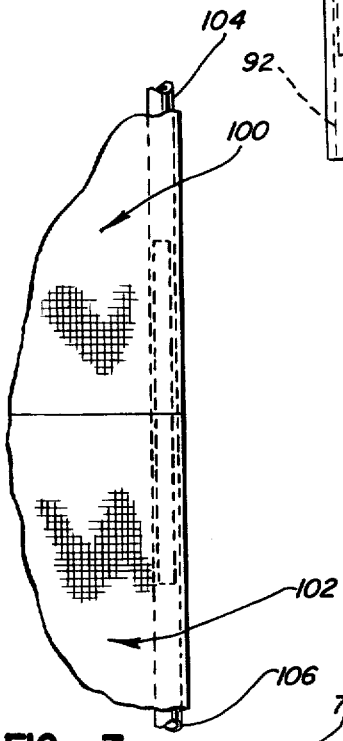
FIG. 7 is a view of a pair of wall panels which abut each other utilizing a tube connector of the present invention in the ends of an opposing pair of tubes in the panel edges.

Assemblies have been constructed utilizing the tube connectors described above in the applications which are mentioned. It has been found desirable to use round tubular members at the edges of the panels which are nominally 1½ inches outer diameter having a wall thickness of approximately 1/32 inches. The tube connectors used in connecting the upper edges of the low and high panels and in connecting the support feet, in accordance with the arrangements shown in FIGS. 1 & 5, have usually incorporated a nominally one inch square post member which is 14 9/16 inches long, while the post members used in the applications with spaced panels, as shown in FIG. 6, have been nominally one inch square and 18 9/16 inches long. The reeds affixed to the post members are thin and flexible, such as of low carbon steel approximately ⅛ inches thick and ⅝ inches wide.

While particular embodiments and modifications of the present invention have been shown and described, it will be understood, of course, that the invention is not limited thereto, since further modifications may be made by those skilled in the art, particularly in light of the foregoing teachings. It is, therefore, contemplated by the appended claims to cover any such modifications as incorporate those features which come within the true spirit and scope of the invention.

What is claimed is:

1. A tube mounting connector for connection with a tubular member having a sleeve portion at one end, which comprises a post member having at least a portion thereof of a configuration to be nestably inserted within such a sleeve portion gripping means attached to said post member and including spaced portions disposed at preselected intervals along the portion of said post member to be inserted within such a sleeve portion, and means for adjustably spacing and holding said spaced portions of said gripping means at variable distances away from said post member for effecting telescopic engagement between said connector and such a tubular member by firm sliding engagement of said post and spaced portions of said gripping means with the inside surface of the sleeve portion of such a tubular member.

2. A portable panel wall system including a first panel comprising a frame including a tubular sleeve having an open end exposed at one end of said panel, a connector including a post member and gripping means attached to said post member and disposed therealong, said post member and gripping means including portions extending within said tubular sleeve, a portion of said connector extending externally of said sleeve, said gripping means including spaced portions disposed along the portion of said post member extending within said tubular sleeve, and means for adjustably spacing and holding said spaced portions of said gripping means at variable distances away from said post member, at preselected intervals along said post member, for effecting telescopic engagement between said connector and the tubular sleeve by firm sliding engagement of said post member and said spaced portions of said gripping means with the inside surface of the tubular sleeve, and a further component of said wall system attached to said external portion of said connector.

3. A portable panel wall system as in claim 2 wherein said sleeve is at the lower end of said panel and said further component is a panel support element.

4. A portable panel wall system as in claim 2 wherein said sleeve is at the upper end of said panel and said further component is telescopically engaged over said external portion thereof.

5. A portable panel wall system as in claim 4 including a second panel, a spacer tube telescopically engaged over said external portion, and means at the upper end of said spacer tube for attaching such upper end to said second panel and thereby attaching said first and second panels to one another.

6. A portable panel wall system as in claim 4 wherein said first panel includes two such tubular sleeves exposed at one end thereof, one of said connectors in each of said tubular sleeves and protruding therefrom, and a second panel having two such tubular sleeves engaged on the protruding portions of said connectors.

7. A portable panel wall system as in claim 6 wherein said first and second panels abut one another.

8. A portable panel wall system as in claim 6 including a spacer tube telescopically engaged over each of said connectors, said first and second panels being connected to one another by said connectors and spaced from one another, by said spacer tubes.

9. The structure of claim 1 or 2 in which said gripping means is an elongated flexible member.

10. A tube mounting connector for connection with a tubular member having a sleeve portion at one end, which comprises a post member having at least a portion thereof of a configuration to be nestably inserted within such a sleeve portion gripping means attached to said post member and disposed along the portion of said post member to be inserted within such a sleeve portion, said gripping means including a first elongated member extending along the portion of said post member to be inserted within such a sleeve portion, and a second elongated member extending along said portion of said post member adjacent said first elongated member, and means for adjustably spacing each of said first and second elongated members away from said post member at preselected intervals along said post member, said elongated members and the adjacent portion of said post member forming a plurality of engagement portions for effecting firm frictional sliding engagement of said connector with the inside of the sleeve portion of such a tubular member.

11. The connector of claim 1, 2 or 10 in which said spacing means comprise elements adjustably engaging one of said post member and said gripping means and abutting the other of said post member and said gripping means.

12. The connector of claim 11 in which said adjustable elements have screw thread engagement with the respective one of said post member and said gripping means in which they are engaged.

13. The connector of claim 12 in which said adjustable elements are threaded set screws and are mounted in and extend through the respective gripping means and abut said post member.

14. The connector of claim 10 in which each of said elongated gripping members is a flexible reed affixed at one end to the post member.

15. The connector of claim 14 including a plurality of threaded elements disposed along each of said reeds whereby portions of the respective reed are maintained in spaced relation to said post member.

16. The connector of claim 14 in which said means for spacing portions of said gripping means away from said post member comprises means adjustably interposed between the respective reed and said post member.

17. The connector of claim 16 in which said means for spacing portions of said gripping means away from said post member includes at least one threaded element extending between the respective reed and said post member.

18. The connector of claim 17 in which said threaded elements are mounted in and extend through the respective reed and into contact with said post member.

19. The connector of claim 17 in which each of said adjustable elements is in threaded engagement with said post member and abuts the respective reed.

20. The connector of claim 19 in which each such reed is provided with an aperture in registry with each of said adjustable elements for adjustment access thereto.

21. The connector of claim 19 in which said post member is provided with an aperture opposite each of said adjustable elements for adjustment access thereto.

22. A method of mounting a tubular member having a sleeve portion at one end onto a post member comprising providing the post member with at least one reed hinged at one end onto the post member and movable along substantially the entire length of the reed to a plurality of preselected distances from the post member, adjusting and fixing the reed at a distance from the post member to establish contact of the post member and the reed on the inside of the sleeve portion, and sliding the sleeve portion of the tubular member over the post member and the reed.

23. A method of mounting a tubular member having a sleeve portion at one end onto a post member comprising:

providing the post member with at least one reed hinged at one end onto the post member and movable along the length of the reed to a plurality of preselected positions spaced apart from the post member, sliding the sleeve portion over the post member to the location of a first adjustment means for fixing the distance of the reed from the post member, adjusting the first adjustment means to provide contact of the body of the post member and the reed with the inside wall of the sleeve portion, sliding the sleeve portion further along the post member to the location of at least one further adjustment means for fixing the distance of the reed from the post member, adjusting the further adjustment means to provide contact of the body of the post member and the reed with the inside wall of the sleeve portion, and sliding the sleeve portion past the further adjustment means.

24. A partition assembly comprising a first panel and a second panel, a first tube in one edge of said first panel, a tube connector including a post member and a flexible reed attached to said post member, said post member and reed being partially disposed in said first tube and extending beyond one edge of said first panel, a second tube disposed over the portion of the tube connector beyond said first panel, said flexible reed including spaced portions disposed along the portions of said post member extending within said first and second tubes, and means for adjustably spacing and holding said spaced portions of said flexible reed at variable distances away from said post member, at preselected intervals along said post member, for effecting telescopic engagement between said connector and said first and second tubes by firm sliding engagement of said post member and said spaced portions of said flexible member with the inner surface of said first and second tubes, and fastening means engaging said second panel and the distal end of said second tube on said first panel for fastening said panels to one another.

25. A partition assembly comprising a first panel and a second panel spaced apart in a vertical distance, each panel including a vertical tube at each vertical edge, and a pair of tube connectors each connector extending from within the end of a tube in said first panel into the end of a tube in said second panel, each connector including a post member and a flexible reed attached at one end to said post member, each connector being fixed in the ends of the respective tubes by the post member and the reed engaging the inside of the end portions of the respective tubes, said flexible reed including spaced portions disposed along the portions of said post member extending within said tubes, and means for adjustably spacing and holding said spaced portions of said flexible reed at variable distances away from said post member, at preselected intervals along said post member, for effecting telescopic engagement between said connector and said tubes by firm sliding engagement of said post member and said spaced portions of said flexible member with the inner surfaces of said tubes.

26. A partition assembly as in claim 25 including a spacer tube encompassing each of said connectors between said first and second panels.

27. A tube mounting connector for connection with a tubular member having a sleeve portion at one end, which comprises a post member having at least a portion thereof of a configuration to be nestably inserted within such a sleeve portion, gripping means attached to said post member and disposed along the portion of said post member to be inserted within such a sleeve portion, said gripping means including first and second reeds adjacent to one another and affixed to said post member at joints spaced apart from each other along the length of said post member, and means for adjustably spacing portions of each of said first and second reeds away from said post member at preselected intervals along said post member, said reeds and the adjacent portion of said post member forming a plurality of engagement portions for frictionally engaging the inside of the sleeve portion of such a tubular member and effecting firm sliding engagement of said connector therewith.

28. A tube connection which comprises, in combination, a tubular member having a sleeve portion at one end, a post member having at least a portion thereof nestably inserted within the sleeve portion at the end of the tubular member, a flexible reed disposed intermediate the inside surface of the sleeve portion of said tubular member and said post member and secured to said post member, said reed including spaced portions disposed at preselected intervals along the portion of said post member within the sleeve portion of the tubular member, and means for adjustably spacing and holding said spaced portions of said reed at variable distances away from said post member for effecting telescopic engagement between the inside of the sleeve portion of said tubular member and said post member by firm sliding engagement of said post member and spaced portions of said reed on the inside surface of the sleeve portion of such tubular member.

29. A tube connection which comprises, in combination, a tubular member, a post member having a configuration nestable within a sleeve portion at the end of the tubular member, first and second flexible reeds disposed intermediate the sleeve portion of said tubular member and said post member and secured to said post member, and means for spacing portions of each of said first and second reeds away from said post member at preselected intervals along said post member said first and second reeds being disposed on adjacent sides of said post member and engaging the inside of the sleeve portion of said tubular member, and said post member having portions which engage said sleeve portion in locations spaced apart from the locations of the first and second reed engagements on the inside of said sleeve portion.

30. The tube connection of claim 29 in which said post member has a rectangular cross-section and said tubular member has a round cross-section, and at least two of the corners of said post member are engaged upon the inside of the sleeve portion of said tubular member at locations spaced apart from the locations of the reed engagement on the inside of said sleeve portion.

31. The tube connection of claim 28 or 29 in which said post member and said tubular member each is of a rectangular cross-section.

32. A portable panel wall system including a first panel comprising a frame including a tubular sleeve having an open end exposed at one end of said panel, and a connector for connection with the tubular sleeve, the connector including a post member having at least a portion thereof of a configuration to be nestably inserted within the open end of the tubular sleeve, gripping means attached to said post member and including spaced portions disposed at preselected intervals along the portion of said post member to be inserted within the open end of the tubular sleeve, and means for adjustably spacing and holding said spaced portions of said gripping means at variable distances away from said post member for effecting telescopic engagement between said connector and the open end of the tubular sleeve by firm sliding engagement of said post member and spaced portions of said gripping means with the inside surface of the sleeve.

* * * * *